United States Patent [19]

Tsujibayashi et al.

[11] 4,008,001

[45] Feb. 15, 1977

[54] ROTOR FOR ROTARY INTERNAL COMBUSTION ENGINE

[75] Inventors: Yoshiyuki Tsujibayashi, Tokyo; Ryuzo Ishihara, Fuchu, both of Japan

[73] Assignee: Nissan Motor Co., Ltd., Yokohama, Japan

[22] Filed: May 16, 1975

[21] Appl. No.: 578,365

[30] Foreign Application Priority Data

May 20, 1974 Japan ..... 49-58033

[52] U.S. Cl. ..... 418/61 A; 123/8.45

[51] Int. Cl.[2] ..... F01C 1/02; F02B 55/02

[58] Field of Search ..... 418/61 A; 123/8.01, 123/8.45

[56] References Cited

UNITED STATES PATENTS

| | | | |
|---|---|---|---|
| 3,102,492 | 9/1963 | Bentele et al. | 418/61 A |
| 3,405,695 | 10/1968 | Jones et al. | 418/61 A |

*Primary Examiner*—John J. Vrablik

[57] ABSTRACT

A rotor for a rotary internal combustion engine having a two-lobe epitrochoidal housing. The rotor is shaped to have lobes each of which is gradually cut at a greater amount toward each of apex portions of the rotor with respect to a rotor profile determined based on an epitrochoidal curve of the housing.

3 Claims, 2 Drawing Figures

ROTOR FOR ROTARY INTERNAL COMBUSTION ENGINE

This invention relates in general to a rotary internal combustion engine and, more particularly, to an improvement over a rotor of a Wankel type rotary internal combustion engine.

In general, a conventional Wankel type rotary internal combustion engine includes a rotor of which profiles are shaped based on an inner surface formed in a two-lobe epitrochoidal curve of a trochoidal housing. Usually, the rotor is so shaped as to have a certain amount of clearance between the outer peripheral surface of the rotor and the inner surface of the trochoidal housing, so that the outer periphery of the rotor does not contact the inner surface of the trochoidal housing during operation of the engine. Also, the rotor has apex portions provided with apex seals adapted to engage with the inner surface of the trochoidal housing to provide sealing functions.

In a known rotary internal combustion engine of the peripheral port type, overlappings will be great due to inherent construction of the engine. Gas communication between an intake port and an exhaust port is interrupted by one of the apex seals of the rotor when the apex seal reaches a point between the intake and exhaust ports. If, however, the apex seal of the rotor is out of engagement with the inner surface of the housing at a location between the intake and exhaust ports, the overlappings of the intake and exhaust ports are determined in dependence on a clearance between one of the profiles of the rotor and the inner surface of the trochoidal housing. Thus, if the clearance mentioned above is less, the overlapping between the intake and exhaust ports are reduced to provide stability in idling operation of the engine. For this reason, it is required that, in the rotary internal combustion engine of the peripheral port type, the clearance between the profile of the rotor and the inner surface of the housing be selected to be as small as possible.

It is therefore an object of the present invention to provide an improved rotor for a Wankel type rotary internal combustion engine, which rotor provides a minimum amount of clearance between the profile thereof and an inner surface of a trochoidal housing of the engine.

It is another object of the present invention to provide an improved rotor for a Wankel type rotary internal combustion engine, which rotor is smoothly rotatable within a trochoidal housing of the engine.

It is a further object of the present invention to provide an improved rotor for a Wankel type rotary internal combustion engine, which rotor provides a minimum overlapping between intake and exhaust ports of the engine.

Figure 1:
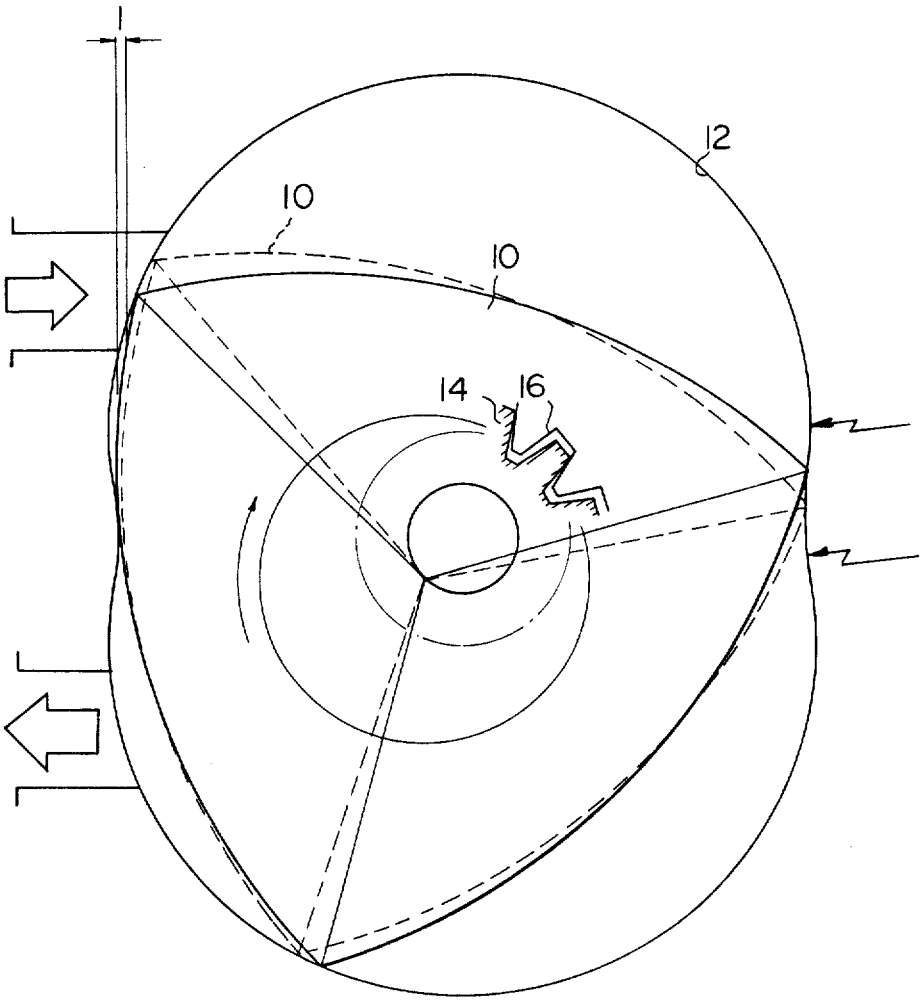
Fig. 1 PRIOR ART
Figure 2:
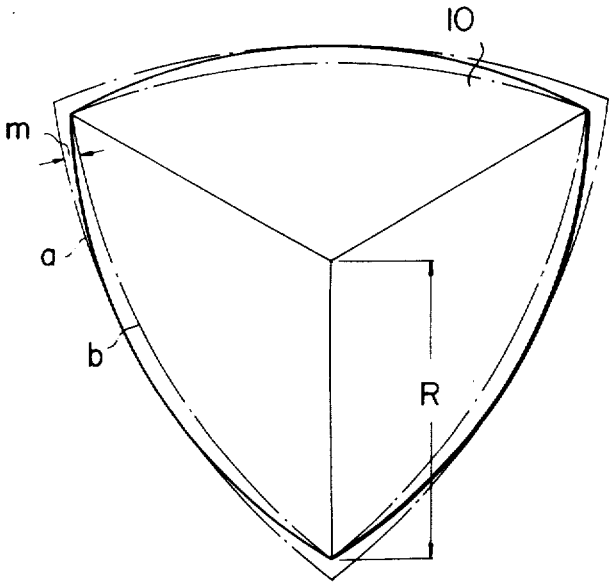

These and other objects, features and advantages of the present invention will become more apparent from the following description when taken in conjunction with the accompanying drawings, in which:

FIG. 1 is a schematic view illustrating the relationship between a rotor and a trochoidal housing of a prior art rotary internal combustion engine; and FIG. 2 is a schematic view of a rotor embodying the present invention.

Referring now to FIG. 1, there is schematically shown a conventional rotary internal combustion engine. Intake and exhaust parts are shown, no reference numeral, with the relatively large arrow heads indicating, respectively, air-fuel flow and exhaust gas flow. The location of spark plugs is indicated by the arrows with the zig-zag shafts. The engine commonly includes a rotor 10, which is eccentrically rotatable within a trochoidal housing having an inner surface 12 shaped on a two-lobe epitrochoidal curve. There exists no problems if the apex portions of the rotor 10 moves along a theoretical locus as shown by broken lines. In an actual operation of the engine, however, the rotor tends to incline with respect to the theoretical locus as shown by a solid line in FIG. 1 because of a clearance formed in a rotor bearing and a backlash formed between inner and outer gears 14 and 16. In this condition, the clearance between the profile of the rotor 10 and the inner surface 12 of the housing is so decreased during rotation of the rotor that the clearance can not be maintained within a given range and interference occurs between the rotor and the housing by which smooth rotation of the rotor is prevented. To overcome this problem, it has heretofore been proposed to increase the clearance between the profile of the rotor and the inner surface of the housing in view of the backlash formed between the gears and other factors such as errors in positioning of component parts of the engine. A problem is encountered in this prior proposal in that it is difficult to provide an ideally minimum amount of clearance between the rotor and the housing and the overlappings between the intake and exhaust ports are necessarily increased whereby the performance efficiency of the engine is deteriorated.

The present invention contemplates to provide an improved rotor which is so shaped as to provide a minimum clearance between the profile of the rotor and an inner surface of a trochoidal housing.

Referring now to FIG. 2, there is shown a preferred embodiment of the rotor according to the present invention. In FIG. 2, a symbol a represents a first rotor profile which is arranged to provide a predetermined amount of clearance between the rotor and the trochoidal housing where the apex portions of the rotor describes an ideal locus within the trochoidal housing during rotation of the rotor. The rotor profile a is shaped such that it is radially inwardly displaced in parallel to the inner envelope of the trochoidal housing with a distance equal to each of the projecting lengths of the apex portions of the rotor. A symbol *b* represents a second rotor profile which is further radially inwardly displaced in parallel to the first profile a with a predetermined distance. The second rotor profile b is determined to have a radius R, by which the rotor is prevented from contacting the inner surface of the housing even when the apex portions of the rotor does not describe the ideal locus within the housing due to mechanical errors of the component parts. As shown by a solid line in FIG. 2, the rotor of the present invention is shaped to have a profile in which each of lobes of the rotor 10 intersects the central portion of each of lobes of the first rotor profile a and each of apices of the rotor 10 intersects each of the apices of the second rotor profile *b*. It will be noted in this instance that, in order to prevent interference between the rotor and the housing, the maximum amount *m* of cutting is preferably selected to be in a range between 0.01R to 0.0001R.

It will now be understood from the foregoing description that according to the present invention the clearance between the rotor and the rotor housing is held at a minimum value even when the rotor apex portions does not describe an ideal locus and overlapping between intake and exhaust ports is minimized to provide an improved operating performance efficiency of the engine.

It will also be noted that even though the rotor of the present invention has a profile including lobes which are gradually reduced in size toward the apex portions of the rotor with respect to a given rotor profile, the compression ratio of the working chamber will be augmented by each of recess formed in the lobes of the rotor and, therefore, the output power of the engine is not effected.

It will further be noticed that a principal concept of the present invention can be applied to a trochoidal housing of a rotary internal combustion engine instead of a rotor.

What is claimed is:

1. In a rotary internal combustion engine having a two-lobe epitrochoidal housing and a peripheral intake and exhaust port arrangement, the improvement comprising said rotor having lobes each of which is cut in the both end portions thereof at a gradually increasing amount toward apex portions of the rotor from a rotor profile based on an inner envelope of an epitrochoidal curve of the housing whereby said rotor at each apex has a radius smaller than that of said rotor profile.

2. The improvement according to claim 1, in which each of the lobes of said rotor intersects each of lobes of said rotor profile at a central portion thereof.

3. The improvement according to claim 1, in which each of said lobes has at both extreme ends maximum retracted portions each of which depth is in a range from 0.0001R to 0.01R, where R is a radius of said rotor.

* * * * *